US008564505B2

(12) United States Patent
Smith

(10) Patent No.: US 8,564,505 B2
(45) Date of Patent: Oct. 22, 2013

(54) IMAGE PROCESSING SYSTEMS

(75) Inventor: Euan Christopher Smith, Cambridgeshire (GB)

(73) Assignee: Cambridge Display Technology Limited (GB)

( * ) Notice: Subject to any disclaimer, the term of this patent is extended or adjusted under 35 U.S.C. 154(b) by 896 days.

(21) Appl. No.: 12/225,451

(22) PCT Filed: Mar. 21, 2007

(86) PCT No.: PCT/GB2007/050139

§ 371 (c)(1),
(2), (4) Date: Mar. 12, 2009

(87) PCT Pub. No.: WO2007/107793

PCT Pub. Date: Sep. 27, 2007

(65) Prior Publication Data

US 2009/0322724 A1 Dec. 31, 2009

(30) Foreign Application Priority Data

Mar. 23, 2006 (GB) ..... 0605755.8

(51) Int. Cl.
*G09G 3/30* (2006.01)

(52) U.S. Cl.
USPC ..... 345/76; 345/211

(58) Field of Classification Search
USPC ..... 345/12–80, 204, 530, 643, 644
See application file for complete search history.

(56) References Cited

U.S. PATENT DOCUMENTS 4,539,507 A 9/1985 VanSlyke et al.
5,361,290 A * 11/1994 Akiyama ..... 377/47
6,054,974 A 4/2000 Sakai et al.
6,108,122 A 8/2000 Ulrich et al.

(Continued)

FOREIGN PATENT DOCUMENTS

CN 1551060 A 12/2004
EP 0953956 A1 11/1999

(Continued)

OTHER PUBLICATIONS

Lee et. al.,Learning the parts of objects by non-negative matrix factorization, Oct. 1999,Nature, vol. 401.*

(Continued)

*Primary Examiner* — Amare Mengistu
*Assistant Examiner* — Stacy Khoo
(74) *Attorney, Agent, or Firm* — Schwegman Lundberg & Woessner, P.A.

(57) ABSTRACT

This invention generally relates to image processing systems. More particularly it relates to systems and methods for displaying images using multi-line addressing (MLA) or total matrix addressing (TMA) techniques, and to techniques for post-processing of data for display generated by these techniques. Embodiments of the invention are particularly useful for driving OLED (organic light emitting diode) displays. We describe a method of driving an electroluminescent display to display an image using a plurality of temporal sub-frames, data for a said sub-frame comprising a first set of drive values (R;C) and second set of drive values (C;R) for driving respective first and second axes of said display, a said sub-frame having an associated sub-frame display time. The method comprises: determining a said sub-frame display time for a displayed sub-frame responsive to one or more of said drive values for the sub-frame; and driving said display to display said temporal sub-frames for respective said sub-frame display times.

27 Claims, 6 Drawing Sheets

(56) References Cited

U.S. PATENT DOCUMENTS

| | | | | |
|---|---|---|---|---|
| 6,346,774 | B1 * | 2/2002 | Tamai et al. | 315/169.1 |
| 7,277,105 | B2 | 10/2007 | Abe | |
| 7,932,915 | B2 * | 4/2011 | Miyata et al. | 345/690 |
| 2003/0062524 | A1 * | 4/2003 | Kimura | 257/72 |
| 2004/0032403 | A1 * | 2/2004 | Sala et al. | 345/204 |
| 2004/0066363 | A1 * | 4/2004 | Yamano et al. | 345/98 |
| 2004/0249615 | A1 * | 12/2004 | Grzeszczuk et al. | 703/2 |
| 2005/0021333 | A1 * | 1/2005 | Smaragdis | 704/236 |
| 2005/0073516 | A1 * | 4/2005 | Kang | 345/204 |
| 2006/0072904 | A1 * | 4/2006 | Bruekers et al. | 386/96 |
| 2007/0046603 | A1 | 3/2007 | Smith et al. | |
| 2007/0069992 | A1 | 3/2007 | Smith et al. | |
| 2007/0085779 | A1 | 4/2007 | Smith et al. | |
| 2007/0223823 | A1 * | 9/2007 | Islam et al. | 382/232 |
| 2008/0246703 | A1 | 10/2008 | Smith | |
| 2008/0291122 | A1 | 11/2008 | Smith et al. | |
| 2009/0195563 | A1 | 8/2009 | Xu et al. | |

FOREIGN PATENT DOCUMENTS

| | | | |
|---|---|---|---|
| EP | 1437704 | A2 | 7/2004 |
| EP | 1834254 | A2 | 9/2007 |
| GB | 2327798 | A | 2/1999 |
| JP | 10-020809 | A | 1/1998 |
| JP | 2001-3311434 | A | 11/2001 |
| JP | 2009-522590 | A | 6/2009 |
| WO | WO-03023251 | A | 3/2003 |
| WO | WO 2004088568 | A2 * | 10/2004 |
| WO | WO-2006/067520 | A2 | 6/2006 |

OTHER PUBLICATIONS

"International Application No. PCT/GB2007/050139, Written Opinion dated Sep. 23, 2008", 6 pgs.

"International Application No. PCT/GB2007/050139, International Search Report", 2 pgs.

"Machine Translation of JP 2001-331143A, published Nov. 30, 2001", 23 pgs.

Eisenbrand, F., et al., "Multiline Addressing by Network Flow", *ESA 2006, Lecture Notes* in Computer Science (LNCS 4168), (2006), 744-755.

"Japanese Application Serial No. 2009-500935, Official Action mailed Jul. 24, 2012", (English Translation), 6 pgs.

* cited by examiner

Number of current sources <= number or rows in display

IMAGE PROCESSING SYSTEMS

RELATED APPLICATIONS

This application is a nationalization under 35 U.S.C. 371 of PCT/GB2007/050139, filed Mar. 21, 2007 and published as WO 2007/107793 A1, on Sep. 27, 2007, which claimed priority under 35 U.S.C. 119 to United Kingdom Patent Application Serial No. 0605755.8, filed Mar. 23, 2006; which applications and publication are incorporated herein by reference and made a part.

BACKGROUND OF THE INVENTION

1. Technical Field

This invention generally relates to image processing systems. More particularly it relates to systems and methods for displaying images using multi-line addressing (MLA) or total matrix addressing (TMA) techniques, and to techniques for post-processing of data for display generated by these techniques. Embodiments of the invention are particularly useful for driving OLED (organic light emitting diode) displays.

2. Description of Related Art

We have previously described how techniques for multi-line addressing (MLA) and total matrix addressing (TMA) in particular using non-negative matrix factorisation (NMF) may be advantageously employed in OLED display driving (see in particular our International application PCT/GB2005/050219, hereby incorporated by reference in its entirety). We now describe further improvements to these techniques in which, broadly speaking, multiple frame sets are employed for noise reduction and improved image quality. Background prior art is described in GB2327798A; EP 0953956A; and U.S. Pat. No. 6,108,122.

Multi Line Addressing and Total Matrix Addressing

To aid in understanding embodiments of the invention we first review multi-line addressing (MLA) techniques, a preferred special case of which comprises total matrix addressing (TMA) techniques. These are preferably employed with passive matrix OLED displays, that is displays which do not include a memory element for each pixel (or colour sub-pixel) and must therefore be continually refreshed. In this specification OLED displays include displays fabricated using polymers, so-called small molecules (for example U.S. Pat. No. 4,539,507), dendrimers, and organometallic materials; the displays may be either monochrome or colour.

In a conventional passive matrix display the display is driven line-by-line and hence a high drive is required for each line because it is only illuminated for a fraction of the frame period. MLA techniques drive more than one line at once and in TMA techniques all the lines are driven simultaneously and an image is built up from a plurality of successively displayed subframes which, when integrated in the observer's eye, give the impression of the desired image. The required luminescence profile of each row (line) is built up over a plurality of line scan periods rather than as an impulse in a single line scan period. Thus the pixel drive during each line scan period can be reduced, hence extending the lifetime of the display and/or reducing the power consumption due to a reduction of drive voltage and reduced capacitive losses. This is because OLED lifetime reduces with the pixel drive (luminance) to a power typically between 1 and 2 but the length of time for which a pixel must be driven to provide the same apparent brightness to an observer increases only substantially linearly with decreasing pixel drive. The degree of benefit depends in part upon the correlation between the groups of lines driven together.

FIG. 1*a* shows row G, column F and image X matrices for a conventional drive scheme in which one row is driven at a time. FIG. 1*b* shows row, column and image matrices for a multiline addressing scheme. FIGS. 1*c* and 1*d* illustrate, for a typical pixel of the displayed image, the brightness of the pixel, or equivalently the drive to the pixel, over a frame period, showing the reduction in peak pixel drive which is achieved through multiline addressing.

The problem is to determine sets of row and column drive signals for the subframes so that a set of subframes approximates the desired image. We have previously described solutions to this problem in International Patent Applications Nos. GB2005/050167-9 (all three of which applications are hereby incorporated by reference in their entirety). A preferred technique employs non-negative matrix factorisation of a matrix describing the desired image. The factor matrices, the elements of which are positive since the OLED display elements provide a positive (or zero) light emission, essentially define the row and column drive signals for the subframes. We describe later one preferred NMF technique in the context of which embodiments of the invention may operate, although techniques may also be employed.

Referring to FIG. 1*a* we first describe an overall OLED display system 100 which incorporates a display drive data processor 150 which may implement embodiments of the invention in either hardware (preferred), software, or a combination of the two.

In FIG. 2*a* a passive matrix OLED display 120 has row electrodes 124 driven by row driver circuits 112 and column electrodes 128 driven by column drives 110. Details of these row and column drivers are shown in FIG. 1*b*. Column drivers 110 have a column data input 109 for setting the current drive to one or more of the column electrodes; similarly row drivers 112 have a row data input 111 for setting the current drive ratio to two or more of the rows. Preferably inputs 109 and 111 are digital inputs for ease of interfacing; preferably column data input 109 sets the current drives for all the U columns of display 120.

Data for display is provided on a data and control bus 102, which may be either serial or parallel. Bus 102 provides an input to a frame store memory 103 which stores luminance data for each pixel of the display or, in a colour display, luminance information for each sub-pixel (which may be encoded as separate RGB colour signals or as luminance and chrominance signals or in some other way). The data stored in frame memory 103 determines a desired apparent brightness for each pixel (or sub-pixel) for the display, and this information may be read out by means of a second, read bus 105 by display drive data processor 150. Display drive data processor 150 preferably performs input data pre-processing, NMF, and post-processing.

FIG. 2*b* illustrates row and column drivers suitable for driving a display with a factorised image matrix. The column drivers 110 comprise a set of adjustable substantially constant current sources which are ganged together and provided with a variable reference current $I_{ref}$ for setting the current into each of the column electrodes. This reference current is pulse width modulated (PWM) by a different value for each column derived from a row of an NMF factor matrix. OLEDs have a quadratic current-voltage dependence, which constrains independent control of the row and column drive variables. PWM is useful as it allows the column and row drive variables to be decoupled from one another.

With PWM drive, rather than always have the start of the PWM cycle an "on" portion of the cycle, the peak current can be reduced by randomly dithering the start of the PWM cycle. A similar benefit can be achieved with less complexity by starting the "on" portion timing for half the PWM cycles at the end of the available period in cases where the off-time is greater than 50%. This is potentially able to reduce the peak row drive current by 50%.

The row driver 112 comprises a programmable current mirror, preferably with one output for each row of the display (or for each row of a block of simultaneously driven rows). The row drive signals are derived from a column of an NMF factor matrix and row driver 112 distributes the total column current for each row so that the currents for the rows are in a ratio set by the ratio control input (R). Further details of suitable drivers can be found in the Applicant's PCT application GB2005/010168 (hereby incorporated by reference). Since (in this arrangement) the row signals are effectively normalised by the row driver, in post-processing the column drive reference current and/or the sub-frame time are adjusted to compensate.

Embodiments of the invention are directed towards aspects of this post-processing. For example the post-processing may adjust the duration of each sub-frame proportional to the brightness of brightest pixel in a sub-frame, so that high luminance is achieved by increased duration as well as increased drive (thus extending pixel lifetime). The relative sub-frame durations may be adjusted (in proportion) so that a desired overall frame rate is maintained.

FIGS. 2*c* and 2*d*, which are taken from GB2005/010168 show example row drivers.

In the example of FIG. 2*c* a bipolar current mirror with a so-called beta helper (Q5) is employed. V1 is a power supply of typically around 3V and digitally controllable current sources 215, 217, I1 and I2 define the ratio of currents in the collectors of Q1 and Q2. The currents in the two lines 252, 254 are in the ratio I1 to I2 and thus a given total column current is divided between the two selected rows in this ratio. Two row electrode multiplexers 256*a, b* are provided to allow selection of one row electrode to provide a reference current and another row electrode to provide an "output" current (sink). This circuit can be extended to an arbitrary number of mirrored rows by providing a repeated implementation of the circuitry within dashed line 258.

In the alternative example of FIG. 2*d* each row is provided with circuitry corresponding to that within dashed line 258 of FIG. 2*c*, that is with a current mirror output stage, and then one or more row selectors connects selected ones of these current mirror output stages to one or more respective programmable reference current supplies (source or sink). Another selector selects a row to be used as a reference input to the current mirror. Again, although only two simultaneously driven rows are shown it will be appreciated that the circuit may readily be extended to drive any number of rows simultaneously with a given current ratio.

In preferred TMA row drivers the illustrated output row selection is not employed and instead a separate current mirror output is provided for each simultaneously driven row of the display.

We now describe one preferred NMF calculation:

An input image is given by matrix V with elements $V_{xy}$, R denotes a current row matrix, C a current column matrix, Q a remaining error between V and R.C, p the number of sub-frames, average an average value, and gamma an optional gamma correction function.

The variables are initialised as follows:

$$av=\text{average}(\text{gamma}(V_{xy}))$$

$$\text{initial}RC=\sqrt{(av/p)}$$

$$Q_{xy}=\text{gamma}(V_{xy})-av$$

An embodiment of the NMF system then performs the following calculation for p=1 to the total number of sub-frames:

start $$Q_{xy}=Q_{xy}+R_{py}C_{xp}$$

for each x and y $$R_{py}=\frac{\text{bias}+\sum_x Q_{xy}C_{xp}}{\text{bias}+\sum_x C_{xp}C_{xp}}$$

for each y $$C_{xp}=\frac{\text{bias}+\sum_y Q_{xy}R_{py}}{\text{bias}+\sum_y R_{py}R_{py}}$$

for each x $$Q_{xy}=Q_{xy}-R_{py}C_{xp}$$

for each x and y loop to start ($p \leftarrow p+1$)

The variable bias prevents division by zero, and the values of R and C pull towards this value. A value for bias may be determined by initialRC×weight×no.of.columns where the number of columns is x and the weight is, for example, between 64 and 128.

Broadly speaking the above calculation can be characterised as a least squares fit. The matrix Q initially begins as a form of target matrix since the row R and column C matrices are generally initialised so that all their elements are the same and equal to the average value initialRC. However from then on matrix Q represents a residual difference between the image and the result of combining the subframes—so ideally Q=0. Thus, broadly speaking, the procedure begins by adding the contribution for subframe p and then for each row finds the best column values, and afterwards for each column finds the best row values. The updated row and column values are then subtracted back from Q and the procedure continues with the next subframe. Typically a number of iterations, for example between 1 and 100, is performed so that the R and C for a set of subframes converge towards a best fit. The number of subframes p employed is an empirical choice but may, for example, be between 1 and 1000.

The factorisation of Q into row and column factor matrices R and C is schematically illustrated in FIG. 1*e*. FIG. 1*f* is schematically illustrates driving a display with one temporal sub-frame using sub-frame data from the row and column factor matrices R and C. The sub-frames are displayed sufficiently rapidly that they combine in the eye of an observer to give the impression of the desired displayed image.

In this description the skilled person will understand that references to rows and columns are interchangeable and that, for example, in the above equation system the order of processing to determine updated $R_{py}$ and $C_{xp}$ values may be exchanged.

In the above set of equations preferably all integer arithmetic is employed, and preferably R and C values comprise 8 bit values and Q comprises signed 16 bit values. Then, although the determination of R and C values may involve rounding off there is no round-off error in Q since Q is updated with the rounded off values (and the product of R and C values cannot be greater than maximum value which can be accommodated within Q). The above procedure may straightforwardly be applied to pixels of a colour display (details later). Optionally a weight W matrix may be employed to weight errors in low luminance values higher, because the eye is disproportionately sensitive to imperfect blacks. A similar weighting may be applied to increase the weight of errors in a green colour channel, because the eye is disproportionately sensitive to green errors.

A typical set of parameters for a practical implementation of a display driver system based upon the above NMF procedure might have a desired frame rate of 25 frames per second, each frame comprising 20 iterations of the procedure, with, for example, 160 subframes. The NMF procedure may be implemented in software, for example on a DSP (digital signal processor) but we have also described (UK patent application no. 0605748.3 filed on 23 Mar. 2006, hereby incorporated by reference) a hardware architecture that enables a cheaper, lower-power implementation of the procedure.

FIG. 3 shows a block diagram of a further example of a OLED display driver system 300. The system of FIG. 3 includes a non-negative matrix factorisation system 310 to perform NMF as described above, either on a DSP or in hardware. The NMF system comprises an NMF processor 304 which is loaded with the target image data and which is coupled to row 306 and column 308 memory blocks for storing factor matrices R and C. The system 300 receives input image data, which may be monochrome or colour video data, and performs optional pre-processing 302 for example for gamma correction. The NMF output from system 310 is provided to a post-processor 312 for implementing an embodiment of the invention as described later. The data is then passed to a controller 314 coupled to display memory 316 and to row 318 and column 320 drivers for driving OLED display 322.

SUMMARY OF THE INVENTION

Broadly speaking we will describe systems and methods for modifying the display time period of individual subframes in order to optimise the benefits of TMA driving. Embodiments offer reduced peak and typical luminances, more efficient operation, increased lifetime and/or reduced drive currents. More generally embodiments facilitate a well-designed trade-off between pixel luminances and peak drive currents.

According to the present invention there is therefore provided a method of driving an electroluminescent display to display an image using a plurality of temporal sub-frames, data for a said sub-frame comprising a first set of drive values (R;C) and second set of drive values (C;R) for driving respective first and second axes of said display, a said sub-frame having an associated sub-frame display time, the method comprising: determining a said sub-frame display time for a displayed sub-frame responsive to one or more of said drive values for the sub-frame; and driving said display to display said temporal sub-frames for respective said sub-frame display times.

In embodiments of this method, by modifying the display time for a sub-frame dependent on one or more of the drive values for the sub-frame, one or more drive parameters may be optimised. For example, by adjusting (lengthening) sub-frame display time in proportion to the luminance of the brightest pixel in the sub-frame the maximum drive to a pixel may be reduced (the longer display time compensating for the reduced drive to give the same apparent luminance) thus increasing display life time.

In some preferred embodiments pulse width modulation (PWM) drive is employed for one of the axes of the display. In this case the duration of a sub-frame may be adjusted by adjusting the period of a clock for the PWM drive; this has the advantage of reduced rounding errors. More particularly, rather than counting up to a maximum possible drive value on this axis, for example 255, the clock can be stretched to instead count up to the actual maximum drive value on this axis for the relevant sub-frame.

In another optimisation the drive to one or other axis of the display may be minimised by adjusting the display time proportional to the maximum drive on the relevant axis, more particularly the maximum drive to a row of column of the display. In a further optimisation the display time for a sub-frame may be adjusted in proportion to the overall drive for the sub-frame, for example to minimise overall drive current from a power source. Additionally or alternatively the display time of a sub-frame may be chosen to optimise a combination of one or more of these display parameters, for example with a linear or power scaling of the parameters.

Various embodiments of the methods described herein include wherein said sub-frame display time is responsive to a product of a maximum value of said first set of drive values and a maximum value of said second set of drives values.

Various embodiments of the methods described herein include wherein said sub-frame display time is responsive to a product of a maximum value of said first set of drive values and a sum of said second set of drive values.

Various embodiments of the methods described herein include wherein said sub-frame display time is responsive to a product of a sum of said first set of drive values and a maximum value of said second set of drive values.

Various embodiments of the methods described herein include wherein said sub-frame display time is responsive to a product of a sum of said first set of drive values and a sum of said second set of drive values.

It will be appreciated that the technique may be employed on a complete image or, in embodiments on a spatial portion or subdivision of an image or on one or more colour planes separately or in combination.

So far as the application of this technique is concerned the order in which the subframes are displayed is not important.

In some preferred embodiments the display driving comprises current driving. Thus, for example, one axis of the display, say a column axis, may be provided with a current drive (source or sink) and the other axis of the display, say a row axis, may be provided with a ratio drive to divide the total drive on the first axis in accordance with a ratio (for each row) determined by the drive values for the second display axis. In some preferred embodiments the axis which does not have a ratioed drive is provided with a pulse width modulated drive. This is especially useful for OLED displays as it allows the drives to the first and second axes of the display effectively to be decoupled from one another.

Where, as described above, PWM drive is employed a reference drive (current) for a sub-frame may be inversely proportional to a duration of the sub-frames. Preferably scaling is applied so that the actual drive signals to the display are within a control range, generally a range within which the response of the display and driver circuitry is relatively linear and accurately controllable. In embodiments of the method employing a PWM drive for one axis of the display it is beneficial to adjust a clock of the PWM drive according to a maximum drive value so that when timing the drive value a counter counts up to this maximum value (rather than, say, keeping the clock constant and counting up to a maximum possible value for the drive). Drive values for the other axis are preferably scaled by left-shifting so that the most significant bit (MSB) of the maximum value is set (a logic "one", assuming normal conventions).

In some preferred embodiments of the method employing PWM control, the PWM clock period is defined with at least 12 bits resolution. Preferably the reference value (current) is defined with at least 10 bits resolution.

In some particularly preferred embodiments the method also includes factorising a target matrix defined by input image data, for example along the lines described in the introduction. Typically the image data is pre-processed, for example to apply a gamma correction, and optionally for other adjustments, prior to factorising. As previously described, preferably the first and second factor matrices are generated, which when multiplied together, approximate the target matrix. One of these describes the first set of drive values (for the first display axis) or each of the subframes, and the other the second set of drive values (for the second axis of the display) for each subframe.

Embodiments of the method are particularly suitable for driving OLED displays. A typical display has a plurality of pixels, optionally of different colours, each addressable by a row electrode and a column electrode. Preferably the display comprises a passive matrix display.

Applications of the method, and also of the display drivers and systems we describe, are however not limited to OLED displays but may also be applied, for example, to an inorganic LED display, a plasma display, a vacuum fluorescent display and to thick and thin film electroluminescent displays such as iFire® displays. The display may be either colour or monochrome.

The invention also provides a driver for an electroluminescent display, in particular for an OLED display, incorporating means for implementing a method according to the invention.

Thus the invention further provides a display driver data processing system for processing data for driving an electroluminescent display to display an image using a plurality of temporal sub-frames, data for a said sub-frame comprising a first set of drive values (R;C) and second set of drives values (C;R) for driving respective first and second axes of said display, a said sub-frame having an associated sub-frame display time, the system comprising: means for determining a said sub-frame display time for a displayed sub-frame responsive to one or more of said drive values for the sub-frame.

In a still further aspect the invention provides a display driver for driving an electroluminescent display with data defining a plurality of temporal sub-frames derived from non-negative matrix factorisation (NMF) of image data, said sub-frames combining, when displayed, to give the impression of an image defined by said image data, said display driver including: a data input; a plurality of row drivers for driving rows of said display; a plurality of column drivers for driving columns of said display; and a timing control system for controlling a timing of said sub-frame display responsive to one or more of row drive data for said row drivers and column drive data for said column drivers.

The skilled person will appreciate that the labelling of one axis of a display as a row axis and another as a column axis is arbitrary and that a "column driver" may be a row driver if it is driving "row" connections of a display, and vice-versa. Likewise in the case of a current drive a driver may implement either a current source or a current sink and as previously mentioned in some preferred embodiments one of the drivers provides a ratioed current drive.

The invention further provides processor control code to implement the above-described methods, for example, on a general purpose computer system or on a digital signal processor (DSP). The code may be provided on a carrier such as a disk, CD- or DVD-ROM, programmed memory such as read-only memory (Firmware). Code (and/or data) to implement embodiments of the invention may comprise source, object or executable code in a conventional programming language (interpreted or compiled) such as C, or assembly code. The above described methods may also be implemented, for example, on a FPGA (field programmable gate array) or in an ASIC (application specific integrated circuit). Thus the code may also comprise code for setting up or controlling an ASIC or FPGA, or code for a hardware description language such as Verilog (Trade Mark), VHDL (Very high speed integrated circuit Hardware Description Language), or RTL code or SystemC. Typically dedicated hardware is described using code such as RTL (register transfer level code) or, at a higher level, using a language such as C. As the skilled person will appreciate such code and/or data may be distributed between a plurality of coupled components in communication with one another.

BRIEF DESCRIPTION OF THE SEVERAL VIEWS OF THE DRAWINGS

These and other aspects of the invention will now be further described, by way of example only, with reference to the accompanying figures in which.

DESCRIPTION OF THE EMBODIMENTS

We will first describe some general classes of sub-frame time calculation methods, and will then give a detailed example.

In embodiments the aim of the post-processing is stretching of the time period of individual sub-frames in order to optimise the benefits of TMA driving. Without time period stretching, depending upon the displayed image, there may be no benefit from TMA. For example with a blank, white screen, where the entire image is generated in only one sub-frame and the others are empty, if all sub-frames were set to the same length then the drivers would have to try to deliver the entire frame current in a fraction of the available frame period.

The sub-frames can be stretched to achieve one of four basic goals, as set out below. More generally a compromise point may be selected between these optimisations. In the following, R denotes a vector of row values for a sub-frame and C a vector of column values for the sub-frame.

1. Minimise the pixel luminances. In this case the length (duration) of each sub-frame will be proportional to the brightest pixel in a given sub-frame which is given by $R_{max}$-$C_{max}$ (where the max subscript denotes the maximum value in the set for the sub-frame).

Figure 2A:
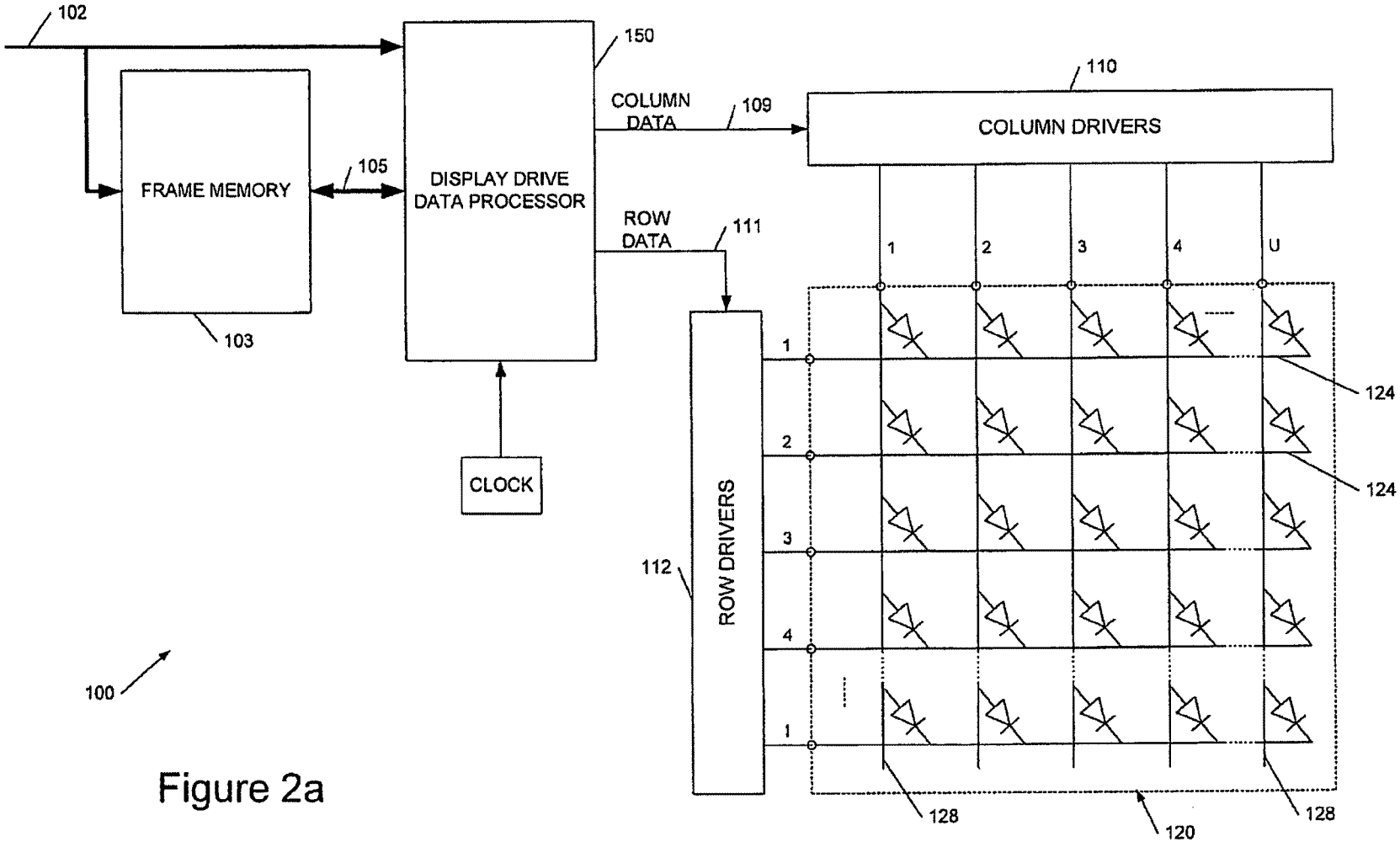
FIGS. 2*a* to 2*d* show, respectively, an OLED display and driver including an NMF hardware accelerator according to an embodiment of the invention, row and column drivers for the system of FIG. 2*a*, and first and second example row drivers.
Figure 2B:
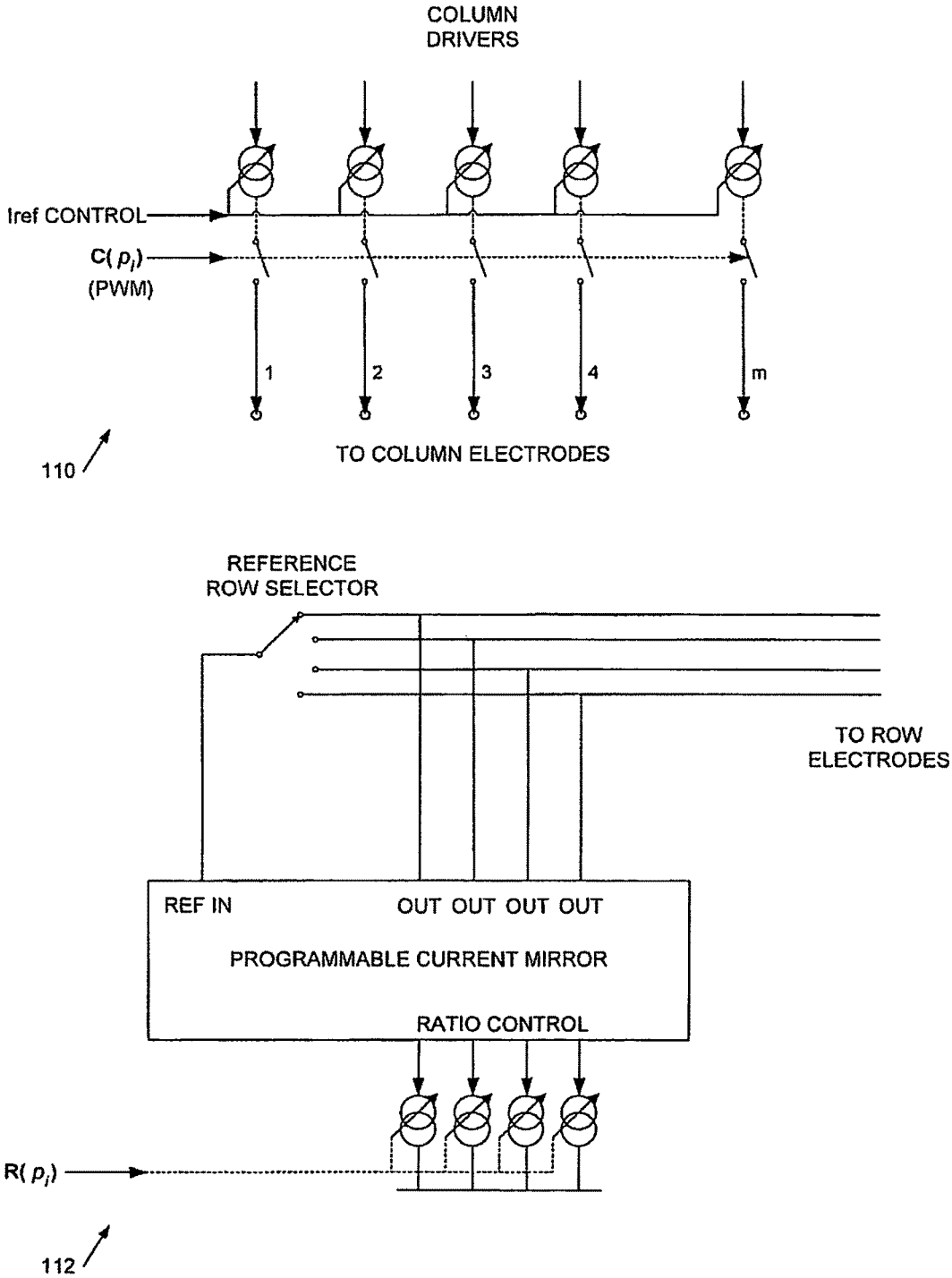
Figure 2C:
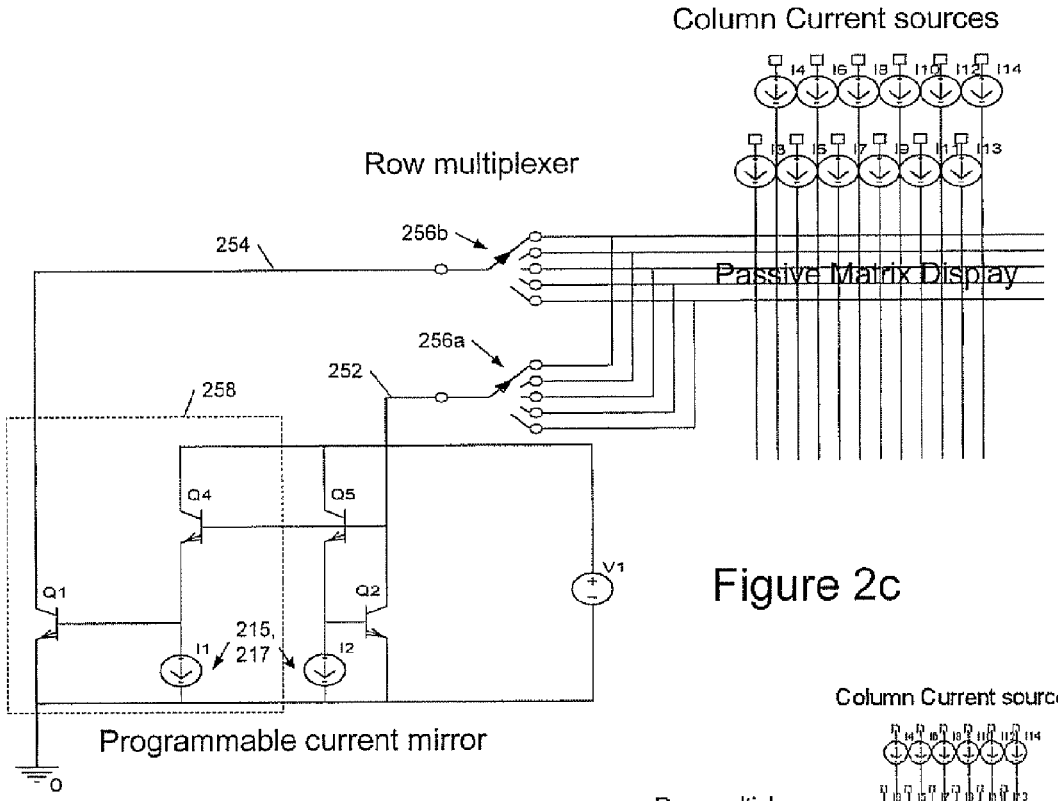
Figure 2D:
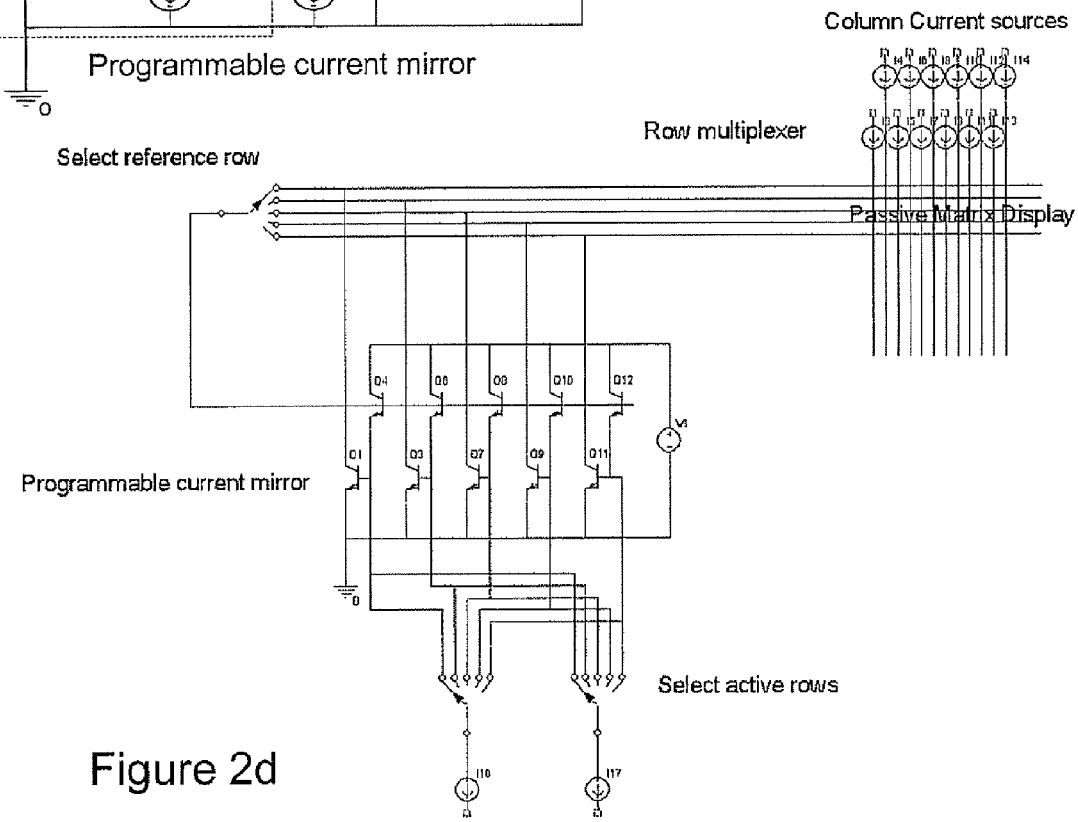
Figure 3:
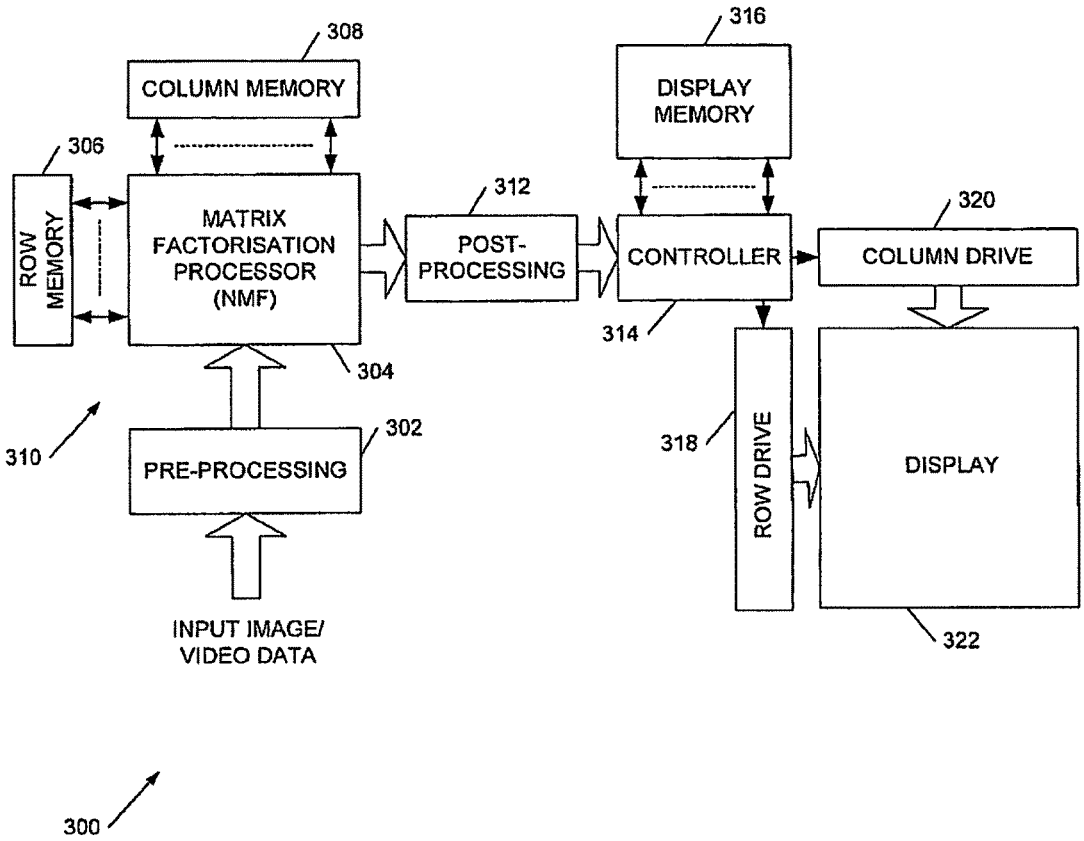
FIG. 3 shows a further example of an OLED display and driver system for implementing an embodiment of the invention.

2. Minimise the row current. The sub-frame length will be proportional to the highest row current which is given by $R_{max}C_{sum}$. This assumes that the columns are the time division (PWM) axis, as shown in FIG. 2*b*, and that the rows are the current (ratio) control axis. It also assumes that the column drive signals are distributed in time effectively, for example by dithering the start time of the "on" pulse, as described earlier. If this is not the case then the peak current will be given by $R_{max}$ times the count of non-zero column signals (as at the start of the sub-frame all the columns will be on). However using this as a basis is sub-optimal, as it can throw up some very poor allocations. Preferably, therefore, it is assumed that the time slots on the time division axis (PWM) are reasonably well distributed.

3. Minimise the column current. This is similar to optimisation (2) above. A similar issue with time slot distribution can arise, depending upon which axis is used for time division or PWM drive (ie. if the rows are the time division axis). It will be appreciated that it is arbitrary which axis of the display is labelled as the "row" axis and which the "column" axis. Ignoring the non-time distributed case, the highest column current would be given by $R_{sum}C_{max}$.

4. Minimise the frame current. This is probably less useful than the previous optimisations unless there are limitations on the overall current supply. However these could perhaps be overcome by other means which would not compromise other aspects of display performance. Nonetheless if it was desired to minimise the frame current then the sub-frame time slots should be proportional to the total subframe current, given by $R_{sum}C_{sum}$.

Figure 1A:
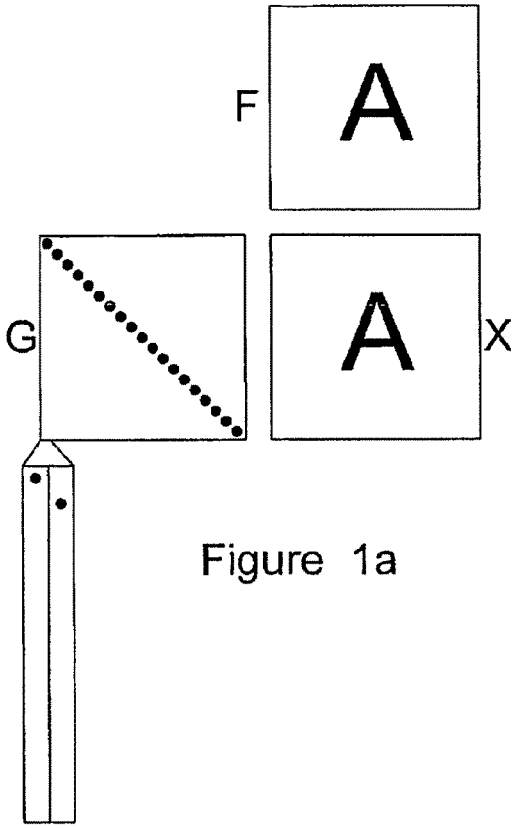
FIGS. 1*a* to 1*f* show row, column and image matrices for a conventional drive scheme and for a multi-line addressing drive scheme respectively, and corresponding brightness curves for a typical pixel over a frame period, factorisation of a target matrix into row and column factor matrices, and driving a display with one temporal sub-frame using sub-frame data from the row and column factor matrices.
Figure 1B:
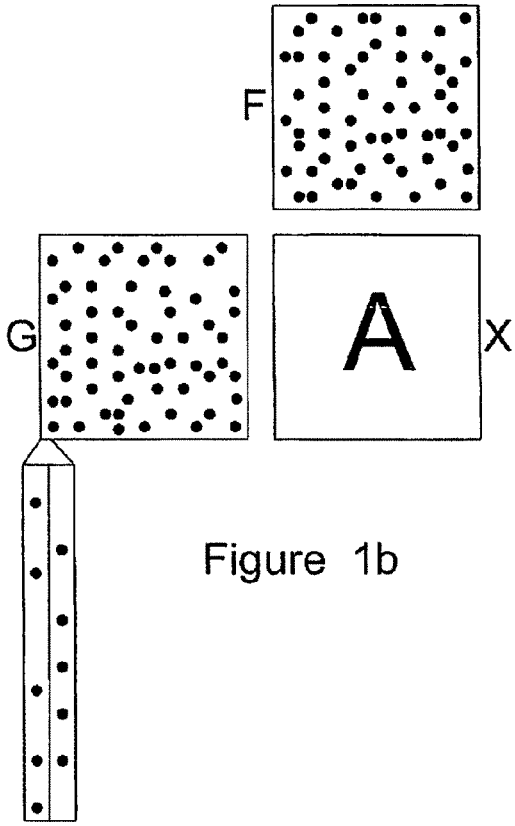
Figure 1C:
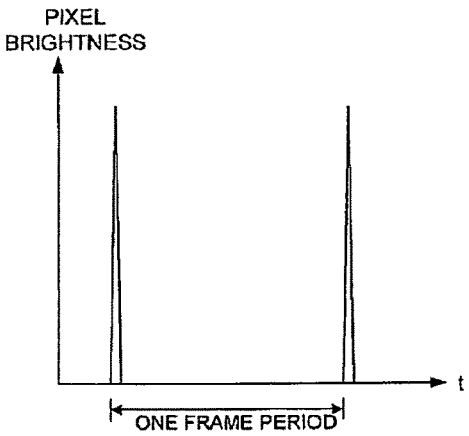
Figure 1D:
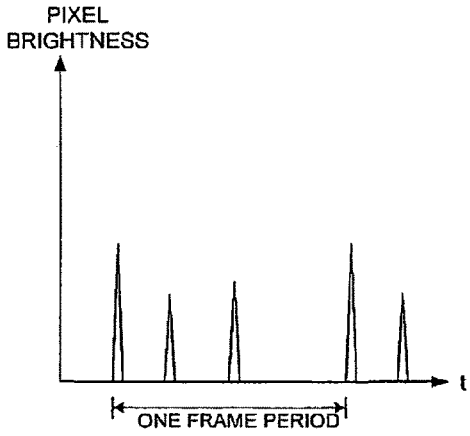
Figure 1E:
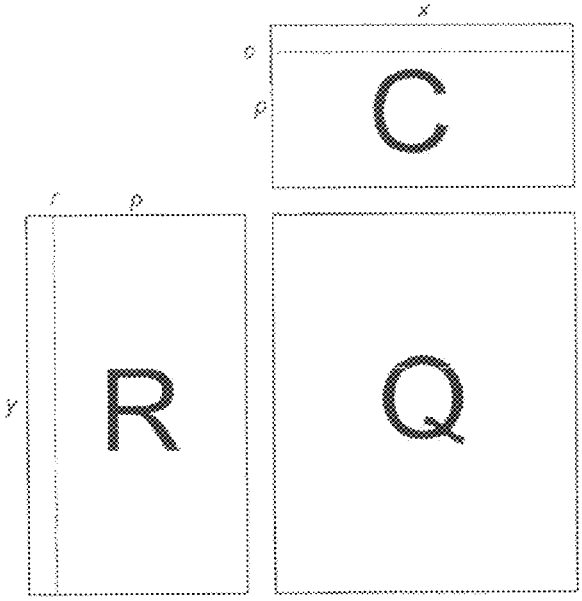
Figure 1F:
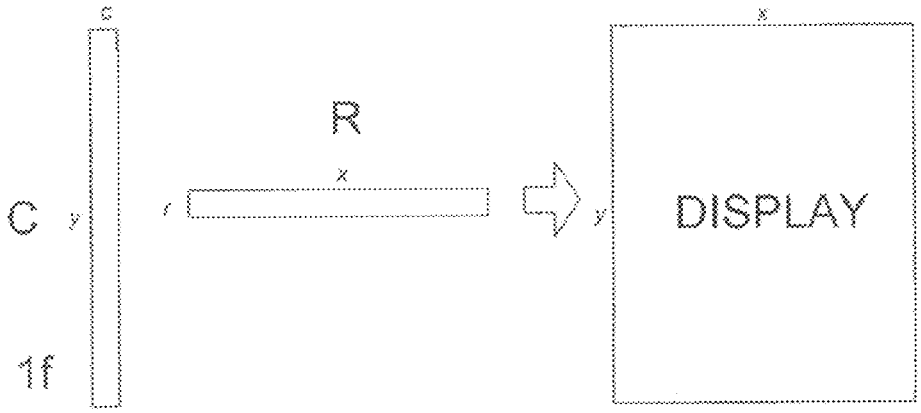
Figure 4:
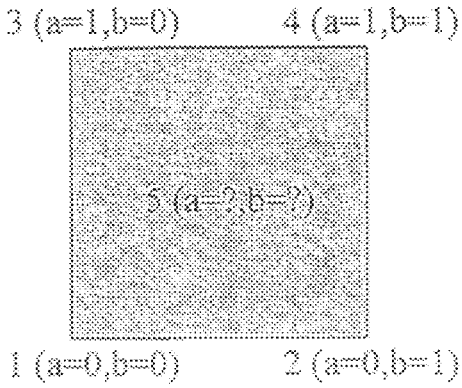
FIG. 4 shows a visualisation of sub-frame time allocation options.

5. Referring to FIG. 4, this shows a visualisation of the above sub-frame time allocation options (1)-(4). The more general case comprises a trade-off between these four options which can be visualised a point (5) within a region defined by the corners of a square. In this more general case the sub-frame time slots may be proportional to $(R_{max})^{(1-a)}(R_{sum})^{a}(C_{max})^{(1-b)}(C_{sum})^{b}$ where a and b can vary from 0 to 1. With this approach other functions, for example a linear function, may also be used to scale between the different extremes (1)-(4). A power scaling was chosen as the max and sum values can be very different in magnitude and their difference can vary from sub-frame to sub-frame. A power scaling, if fixed, can be easily implemented as a look-up table, particularly as the time slots do not need to be too precisely calculated so long as they are roughly correct. It is the calculations that follow the time allocation which preferably need to be precise.

Once the optimisation criteria has been decided, the frame time is sub-divided up into slots proportional to the criteria, more particularly in proportion to the value of the optimisation criterion, for example $R_{sum}C_{max}$. Generally there will be minimum limits to the length of the time slots with criteria where a sub-frame is deemed too insignificant to be displayed. A minimum useful sub-frame time slot may be defined (for example sub-frames may be allocated durations in terms of a number of cycles of a system clock), in which case a sub-frame may be deemed insignificant if it has a duration of less than a time slot, or of less than half a time slot.

We next describe preferred implementations of the above techniques in the context of a driver arrangement such as that shown in FIG. 2*b*. Preferably therefore one driver axis provides a pulse width modulated current drive scaled by a reference current. Preferably the other axis provides a ratioed current control, dividing the currents on this axis in accordance with relative ratios specified by ratios of the corresponding drive values for the axis.

We first describe determination of a PWM reference.

The reference current is calculated based on the time allocated. This will be proportional to the total sum of the current control axis in a given sub-frame and inversely proportional to the sub-frame time. If the reference current exceeds the limit than it is set to the limit and the sub-frame time is re-adjusted. Optionally the other sub-frame times can be scaled to make room.

We next describe bit-shifting the R and C values.

On the current control (ratio) axis to ensure all components are well within their control ranges it is best to scale the values in a given sub-frame so that the most significant bit (MSB) of the maximum value is set. For example, if the data is 8-bit and if the maximum value is 35 then all data on that axis should be shifted two bits to the left (i.e. multiplied by 4) giving a maximum value of 140 (i.e. between 128 and 255).

On the time control pulse-width modulated) axis it is best to stretch the pulses to fill the available time. Thus the "on" time of the PWM drive may effectively be stretched so that it is substantially equal to the PWM clock period. The simplest way to do this, rather than scaling the values, is to stretch the PWM clock and only count up to the maximum value. Stretching the values would introduce round-off error, which is unnecessary given the simple alternative. This is done in the detailed example given below. Moreover, in this example the PWM clock pulse length is calculated directly at the time allocation phase rather than performing an extra division later.

We now give a detailed example of a preferred sub-frame time calculation method, which was implemented based on optimisation (1) above.

In this example the time control (PWM) axis was the row axis and the current (ratio) control axis was the column axis. Thus the designation of row and column drivers is exchanged with respect to that shown in FIG. 2*b*.

Detailed Example of Post-Processing Calculations

We will first give the calculations employed, and then the reasoning behind them.

For each sub-frame p calculate:

$$C_p^{max} = \max(C_{px}) \text{ over all x,} \tag{1}$$

$$R_p^{max} = \max(R_{py}) \text{ over all y,} \tag{2}$$

and, for a colour display, $$C_p^{sum} = \frac{I_{red}\sum_{x=0,3,6\ldots}^{357} C_{px} + I_{green}\sum_{x=1,4,7\ldots}^{358} C_{px} + I_{blue}\sum_{x=2,5,8\ldots}^{359} C_{px}}{2^9} \tag{3}$$

where $I_{red}$, $I_{green}$, and $I_{blue}$ are the relative (reference) drive levels of the red, green and blue pixels (10-bit values) compared to a nominal reference of, in this example, $2^9$.

The aim in this example is to minimise the pixel luminances and therefore duration of each sub-frame is proportional to $R_{max}C_{max}$ (the luminance of the brightest pixel). Thus we calculate the sum:

$$T = \sum_p C_p^{max} R_p^{max} \tag{4}$$

The PWM clock period for a sub-frame, $t_p$ is given by:

$$t_p = \frac{2^{20} C_p^{max}}{T} \tag{5}$$

The minimum value of $R^{max} \times t_p$ is 1024; the maximum value is $2^{20}-1$. Where $R^{max} \times t_p$ is less than 512 $t_p$ should be rounded to zero; where it is between 512 and 1024 $t_p$ should be rounded up such that $R^{max} \times t_p$ equals 1024. (The duration of sub-frame p is $t_p R_p^{max}$).

The PWM reference current is then given by:

$$i_p = \frac{2^{12} C_p^{sum}}{5 t_p R_p^{max}} \tag{6}$$

then, if $i_p$>4095 then set to 4095 and calculate $$t_p = \frac{2^{12} C_p^{sum}}{5 \times 4095 R_p^{max}} \tag{7}$$

The R matrix is passed to the row (PWM) controller unchanged. Each subframe vector of C (defining the current ratios) should be multiplied by $2^n$ such that the maximum value of C in any subframe has its most significant bit set.

Equations (1) to (7) above define a preferred embodiment of the post-processing procedure. This may be implemented in software, for example n a DSP or, in some preferred embodiments, in hardware (see our hardware architecture patent application, ibid).

We now explain the working behind the above example procedure, beginning with timing.

In general the starting point for working out the post processing is always the timing. This has a clear bounding, the length of one frame (for example, 10 ms), and a clear criteria for distribution—in this case minimise the peak drive level through the pixels. To achieve this the lengths of the sub-frames should be distributed such that the peak pixel current ($C_p^{max} R_p^{max}$) is substantially constant for all sub-frames, therefore each sub-frame should last a time defined as $$C_p^{max} R_p^{max} \Big/ \sum_p C_p^{max} R_p^{max}$$

relative to the frame time.

To determine the precision of the sub-frame time we need the minimum useful sub-frame display period. In trials this has been found to be around 10 μs from both simulation and minimum programming time. This is equal to 1/1000 of the (presumed 10 ms) frame time, giving a required 10 bits (1024) precision. We add an extra 2 bits tolerance, giving a $2^{12}$ constant. As we actually wish to pass the PWM clock pulse duration, and there will be $R_p^{max}$ clock pulses in one sub-frame, we need to divide the sub-frame time period ($t_p R_p^{max}$) by $R_p^{max}$ by cancelling it from the numerator in equation (5). Given the range of R (in this example, 8 bits) we need to increase the precision of the $t_p$ value to $2^{12+8}=2^{20}$. This gives us equation (4) for the denominator and (5) for the numerator.

The maximum possible value of $t_p$ occurs when there is only one non-zero sub-frame and where this sub-frame has $R_{max}=1$. In this case $t_p=2^{20}$ (ignoring the −1) which represents a single PWM clock pulse which lasts the entire frame period ~10 ms, and therefore a $t_p$ value of one represents 10 ms/$2^{20}$~=10 ns=one 100 MHz clock pulse. The time a given pixel x,y will be on for in a given subframe p will therefore be given by:

$$t_{xy} = t_p R_{py} \cdot 10 \text{ ns} \tag{8}$$

We next explain how the reference current is determined.

The reference current for a sub-frame is the current delivered by a row when on (in the present example the row and column drives are swapped with respect to the configuration of FIG. 2*b*). This needs to be shared between all active columns in the correct proportion to produce the correct pixel currents. Therefore this current needs to be proportional to the sum of all the column values (weighted by the appropriate RGB reference current weights). Further, as it is the total integrated charge through a pixel which preferably needs to be controlled, the reference current should be inversely proportional to the sub-frame length given in equation (8) (ignoring the constant for the moment). Therefore we have:

$$i_p = k \frac{C_p^{sum}}{t_p R_p^{max}} \tag{9}$$

where k is an unknown constant of proportionality.

The simplest way to work out k is though a simple known image—in this case a white screen.

Assume that all colour reference values are equal and of value $2^9$, that the white screen is shown in only one sub-frame, and that, in that sub-frame, all row and column values equal 255. This gives:

$$C_1^{max}=255, R_1^{max}=255, C_1^{sum}=255 \times 360$$

from equations (4) and (5), and $$T=255 \times 255, t_p=2^{20}/255$$

and therefore from equation (9):

$$i_p = k \frac{255 \times 360}{(2^{20}/255) \times 255} = k \frac{255 \times 360}{2^{20}} \tag{10}$$

Here $i_p$ is a 12 bit value so it has a maximum of 4096. This maximum should be, from simulation, approximately 16 times the nominal required for a white screen. However it is desirable to leave plenty of overhead and to maintain resolution (so that round-off error does not become too significant). It was found that 12 bits was insufficient for the desired quality—for this a minimum current of 1/64 of the white screen case and a maximum of 160 times was needed, requiring 14 bits in total. A compromise was therefore chosen that gives a maximum reference of 41 mA in steps of 10 μA, satisfying the requirement of at least 64 steps for the white-screen case (72 steps are provided) with a generous of overhead (~57 times). Thus the nominal $i_p$ for a white screen was chosen to be 72, representing 720 μA. Putting this value into (10) we have:

$$k = \frac{72 \times 2^{20}}{255 \times 360} = \frac{2^{20}}{255 \times 5} \approx \frac{2^{12}}{5} \tag{11}$$

Substituting this constant back into equation (9) gives equation (6) as specified earlier.

We now give an example of image reconstruction.

The light $L_{xyp}$ emitted by a pixel x,y, during subframe p is equal given by:

$$L_{xyp} = \underbrace{\eta_{colour}}_{efficiency} \cdot \underbrace{i_p \frac{I_{colour} C_{px}}{2^9 C_p^{sum}}}_{current} \cdot \underbrace{t_p R_{py}}_{time} \tag{12}$$

For a given sub-pixel colour there will be a particular target peak luminance. The value of interest is the relative luminance contribution when compared to the target peak:

$$V_{xyp} = a \frac{L_{xyp}}{L_{colour}} \tag{13}$$

The constant a is included to provide a scaling to the range of values it is desired to obtain. In this example we wish the maximum luminance to correspond to 255×255, so a=65025. Then, substituting in (12):

$$V_{xyp} = \underbrace{a \frac{\eta_{colour}}{L_{colour}} \frac{I_{colour}}{2^9}}_{constant} \cdot i_p \frac{C_{px}}{C_p^{sum}} \cdot t_p R_{py} \tag{14}$$

The first terms are all grouped as a constant as the relative reference current will be proportional to the target peak luminance and inversely proportional to the efficiency of the colour, and hence $\eta_{colour} I_{colour} / L_{colour}$ will always have a constant value. These constants can be combined into one constant, b:

$$V_{xyp} = b \cdot i_p \frac{C_{px}}{C_p^{sum}} \cdot t_p R_{py} \tag{15}$$

We would like choose the constant b so that $V_{xyp} = C_{px} R_{py}$, so substituting in and re-arranging:

$$b = \frac{C_p^{sum}}{i_p t_p} \tag{16}$$

and then substituting in (6):

$$b = \frac{C_p^{sum}}{\frac{2^{12} C_p^{sum}}{5 t_p R_p^{max}} t_p} = \frac{5 R_p^{max}}{2^{12}} \tag{17}$$

Then back-substituting into (15):

$$V_{xyp} = \frac{5 R_p^{max} i_p t_p}{2^{12} C_p^{sum}} R_{py} C_{px} \tag{18}$$

The terms in the ratio should preferably produce a value close to 1. For the example of a single non-zero subframe with all 255 values, for example, the ratio=1.0039.

Finally, (18) can be expressed in matrix terms. Then if we define a square diagonal matrix D of size p×p, whose non-zero elements can be defined as:

$$D_{pp} = \frac{5 R_p^{max} i_p t_p}{2^{12} C_p^{sum}} \tag{19}$$

then it follows that, for a final reconstructed image V:

$$V_{xy} = (R_{py})^T D_{pp} C_{px} \tag{20}$$

The skilled person will understand that the above described post-processing techniques may be implemented in either software, or dedicated hardware such as an FPGA or ASIC, or in a combination of the two.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of driving an electroluminescent display using multi-line addressing (MLA) to display an image using a plurality of temporal sub-frames, the method comprising:

inputting image data defining said image;

determining, from said image data, data defining a plurality of said temporal sub-frames, said sub-frames combining, when displayed successively, to give an impression of said image;

data for said sub-frame comprising a first set of drive values and second set of drive values for driving respective first and second axes of said display, wherein said first axis comprises a row axis comprising a plurality of rows of said display and said second axis comprises a column axis comprising a plurality of columns of said display, and wherein said sub-frame has an associated sub-frame display time, wherein said time is a duration;

driving a plurality of columns of said display using said second set of drive values at the same time as driving a plurality of rows of said display using said first set of drive values;

determining said sub-frame display time for said displayed sub-frame responsive to one or more of said drive values for the sub-frame; and driving said display using multiline address to successively display each of said temporal sub-frames for respective said sub-frame display times including said determined sub-frame time, to approximate display of said image data, wherein said displaying a first said temporal sub-frame comprises driving a pixel of said display and said displaying a second said temporal sub-frame comprises driving said pixel, the method further comprising inputting image data defining a target matrix corresponding to said image; and factorising said target matrix to determine first and second factor matrices respectively defining said first and second sets of drive values for said plurality of sub-frames.

2. A method as claimed in claim 1 wherein said sub-frame display time is responsive to a product of a maximum value of said first set of drive values and a maximum value of said second set of drives values.

3. A method as claimed in claim 1 wherein said sub-frame display time is responsive to a product of a maximum value of said first set of drive values and a sum of said second set of drive values.

4. A method as claimed in claim 1 wherein said sub-frame display time is responsive to a product of a sum of said first set of drive values and a maximum value of said second set of drive values.

5. A method as claimed in claim 1 wherein said sub-frame display time is responsive to a product of a sum of said first set of drive values and a sum of said second set of drive values.

6. A method as claimed in claim 1 wherein said sub-frame display time is responsive to a combination of two or more of: a maximum value of said first set of drive values, a maximum value of said second set of drive values, a sum of said first set of drive values, and a sum of said second set of drive values.

7. A method as claimed in claim 1 wherein said driving comprises driving one of said first and second axes of display with a pulse width modulated (PWM) drive, the method further comprising adjusting a clock period of said PWM drive to adjust said sub-frame display time.

8. A method as claimed in claim 7 wherein said PWM driving comprises driving with a pulse width modulated reference value, the method further comprising adjusting said reference value for a sub-frame dependent upon an inverse of said display time for the sub-frame.

9. A method as claimed in claim 7 wherein values of said first set of drive values have a digital representation, the method further comprising left-shifting values of said first set of drive values such that a most significant bit of said digital representation is set for a maximum one of said first set of drive values.

10. A method as claimed in claim 7 further comprising, controlling, said PWM clock period to at least 12 bits resolution.

11. A method as claimed in claim 1 wherein said driving comprises driving one of said first and second axes of display with a pulse width modulated (PWM) drive, the method further comprising stretching a drive "on" period of said PWM drive such that a maximum drive value for the respective axis of the display for the sub-frame is substantially equal to a clock period of said PWM drive.

12. A method as claimed in claim 1 further comprising driving said first axis of said display with values determined by relative ratios of said first set of drive values; and driving said second axis of said display with pulse width modulated values determined by said second set of drive values.

13. A method as claimed in claim 12 wherein said PWM driving comprises driving said second axis of said display and adjusting said PWM clock responsive to a maximum one of said second set of drive values to scale said pulse width modulated values.

14. A method as claimed in claim 1 wherein said display comprises an OILED display.

15. A carrier carrying processor control code to, when running, implement the method of claim 1.

16. A method as claimed in claim 1, wherein said multi-line addressing comprises total matrix addressing.

17. A display driver for driving an electroluminescent display, wherein the display driver is configured to use multi-line addressing to display an image using a plurality of temporal sub-frames, the display driver comprising:

means for inputting image data defining said image;

means for processing said image data to determine data defining a plurality of said temporal sub-frames, said sub-frames combining, when displayed successively, to give an impression of said image, data for said sub-frame comprising a first set of drive values and second set of drives values for driving respective first and second axes of said display, wherein said first axis comprises a row axis comprising a plurality of rows of said display and said second axis comprises a column axis comprising a plurality of columns of said display, and wherein said sub-frame has an associated sub-frame display time, wherein said time is a duration;

means for driving a plurality of columns of said display using a second set of drive values at the same time as driving a plurality of rows of said display using said first set of drive values;

means for determining said sub-frame display time for said displayed sub-frame responsive to one or more of said drive values for the sub-frame; and means for driving said display using multiline addressing to successively display each of said temporal sub-frames for respective said sub-frame times including said determined sub-frame time, to approximate display of said image data, wherein said displaying a first said temporal sub-frame comprises driving a pixel of said display and said displaying a second said temporal sub-frame comprises driving said pixel; and means for inputting image data defining a target matrix corresponding to said image and for factorising said target matrix to determine first and second factor matrices respectively defining said first and second sets of drive values for said plurality of sub-frames.

18. A display driver as claimed in claim 17 further comprising means for calculating a PWM clock period for adjusting said sub-frame display time.

19. A display driver of claim 17, wherein said means for driving comprises a row driver for driving said rows of said display with values determined by relative ratios of said first set of drive values; and a column driver for driving said column of said display with a pulse width modulated values determined by said second set of drive values.

20. A display driver as claimed in claim 17 wherein said electroluminescent display comprises an OLED display.

21. A display driver as claimed in claim 17 wherein said plurality of temporal sub-frames are derived from non-negative matrix factorisation (NMF) of said image data;

wherein said means for driving comprises a plurality of row drivers for driving said rows of said display and a plurality of column drivers for driving said columns of said display;

wherein said first and second sets of drive values comprises, respectively, row and column drive data; and wherein said means for determining said sub-frame display time comprises a timing control system for controlling a timing of said sub-frame display responsive to one or more of said row drive data for said row drivers and said column drive data for said column drivers.

22. A display driver as claimed in claim 21 wherein said timing control system includes a system for controlling a timing of a PWM drive signal for one of said plurality of row and column drivers.

23. A display driver as claimed in claim 21 wherein said image data defines an image matrix, the display driver comprises an NMF system to factorise said image matrix into a product of at least first and second factor matrices, said first factor matrix defining row drive data for said row drivers, said second factor matrix defining column drive data for said column drivers.

24. A display driver as claimed in claim 21 wherein said row drivers comprise ratioed current drivers to provide a current drive ratio for said rows in accordance with said row drive data, and wherein said column drivers comprise pulse width modulated current drivers to provide current to said columns in accordance with said column drive data.

25. A display driver as claimed in claim 21 wherein said electroluminescent display comprises an OLED display.

26. A display driver as claimed in claim 21 further comprising an NMF hardware accelerator to perform said non-negative matrix factorisation (NMF).

27. A display driver as claimed in claim 17, wherein said multi-line addressing comprises total matrix addressing.

* * * * *

UNITED STATES PATENT AND TRADEMARK OFFICE

CERTIFICATE OF CORRECTION

PATENT NO. : 8,564,505 B2
APPLICATION NO. : 12/225451
DATED : October 22, 2013
INVENTOR(S) : Euan Christopher Smith It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1066 days.

Signed and Sealed this
Second Day of June, 2015

Michelle K. Lee

Michelle K. Lee
*Director of the United States Patent and Trademark Office*